US008913076B1

(12) United States Patent
Aggarwal et al.

(10) Patent No.: US 8,913,076 B1
(45) Date of Patent: Dec. 16, 2014

(54) METHOD AND APPARATUS TO IMPROVE THE USABILITY OF THUMBNAILS

(75) Inventors: Anurag Aggarwal, Noida (IN); Kriti Agarwal, New Delhi (IN)

(73) Assignee: Adobe Systems Incorporated, San Jose, CA (US)

( * ) Notice: Subject to any disclaimer, the term of this patent is extended or adjusted under 35 U.S.C. 154(b) by 349 days.

(21) Appl. No.: 13/193,158

(22) Filed: Jul. 28, 2011

(51) Int. Cl.
*G09G 5/02* (2006.01)

(52) U.S. Cl.
USPC ..... 345/593; 345/592

(58) Field of Classification Search
CPC ..... G06Q 10/101; G06Q 10/10
See application file for complete search history.

(56) References Cited

U.S. PATENT DOCUMENTS 6,002,397 A * 12/1999 Jaaskelainen, Jr. ..... 715/805
6,664,983 B2 * 12/2003 Ludolph ..... 715/775
7,739,622 B2 * 6/2010 DeLine et al. ..... 715/835
7,788,593 B1 * 8/2010 Grechishkin et al. ..... 715/778
2005/0093868 A1 * 5/2005 Hinckley ..... 345/502
2008/0229237 A1 * 9/2008 Pagan ..... 715/797

OTHER PUBLICATIONS

Cisco, "WebEx Meeting Center User Guide", Jul. 23, 2010 v27.25, all pages.*

* cited by examiner

*Primary Examiner* — Kee M Tung
*Assistant Examiner* — Nicholas R Wilson
(74) *Attorney, Agent, or Firm* — Moser Taboada

(57) ABSTRACT

A method and apparatus to improve the usability of thumbnails. In an embodiment, a computer implemented method for creating a thumbnail comprises generating a snapshot representing at least a portion of a view containing a plurality of windows, where each window has a window attribute, scaling the snapshot to a reduced size to form a thumbnail, and enhancing a representation of each window represented in the thumbnail based upon the window attribute of each window in the plurality of windows.

20 Claims, 6 Drawing Sheets

METHOD AND APPARATUS TO IMPROVE THE USABILITY OF THUMBNAILS

BACKGROUND OF THE INVENTION

1. Field of the Invention

Embodiments of the present invention generally relate to software programs that represent information in a thumbnail, and, more particularly, to a method and apparatus to improve the usability of thumbnails.

2. Description of the Related Art

One form of thumbnail comprises a reduced-size (scaled) version of an image. Such thumbnails are useful for recognizing and organizing images similar to the way a normal text index helps to identify and organize words. Visual search engines and image-organizing programs normally use thumbnails, as do most modern operating systems or desktop environments, such as Microsoft Windows, Mac OS X, KDE, GNOME, among others.

Further, thumbnails are used in applications to show reduced size previews of a portion of a screen/region and/or reduced size versions of documents. Conventional thumbnails show a miniature version of a screen region they are representing exactly as the region is otherwise visible, i.e., the view of the thumbnail is limited to the visible layer of the represented screen region. From the thumbnail alone, a user does not have a way to determine if there are any hidden content/layers behind the visible content. For example, a region having a first window overlapping or covering a second window, when scaled to a thumbnail, will also have the windows overlapping. Thus, the information within the second window is fully or partially obscured and may be fully or partially covered by the first window. Moreover, after scaling the windows to form a thumbnail, even partially covered windows are hard to interpret. Additionally, the scaling process may result in the window boundaries becoming merged (more so if the windows are near each other) to such an extent that the thumbnail no longer represents the arrangement of the windows on the screen.

Further, for document representations, there may be many such hidden layers that may go unnoticed by the user. For example, the user may be searching for certain content which is actually hidden behind other content on a screen being viewed by the user. A thumbnail representation is useless in displaying the hidden content. Moreover, the top layer of the content is often not very informative to the user as the underlying layers. For example, if a document is made into a thumbnail representation, the thumbnail image shows the first page which may not be informative to the user e.g., the first page may be blank or contain only a confidentiality notice. The title or abstract of the document may be on a subsequent page, which may be the preferred view for a thumbnail. Current thumbnail generation techniques scale only the visible content to form the thumbnail; thus, occluding the underlying pages.

Therefore, there is a need for a method and apparatus to improve the usability of thumbnails.

SUMMARY OF THE INVENTION

The present invention generally relates to a method and apparatus to improve the usability of thumbnails. In an embodiment, a computer implemented method for creating a thumbnail comprises generating a snapshot representing at least a portion of a view containing a plurality of windows, where each window has a window attribute, scaling the snapshot to a reduced size to form a thumbnail, and enhancing a representation of each window represented in the thumbnail based upon the window attribute of each window in the plurality of windows.

Figure 1:
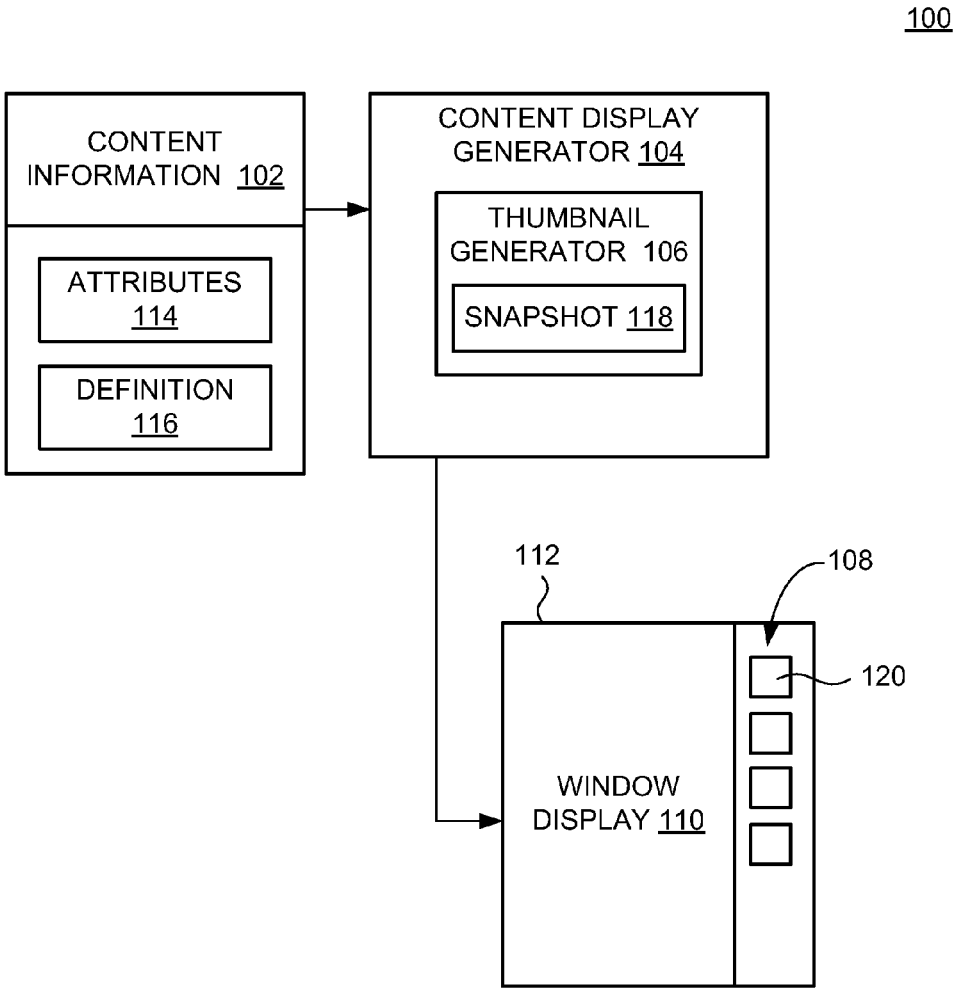
FIG. 1 depicts a functional block diagram for performing thumbnail generation, according to one or more embodiments.

While the system and method for creating a thumbnail is described herein by way of example for several embodiments and illustrative drawings, those skilled in the art will recognize that the system and method for creating the thumbnail is not limited to the embodiments or drawings described. It should be understood, that the drawings and detailed description thereto are not intended to limit embodiments to the particular form disclosed. Rather, the intention is to cover all modifications, equivalents and alternatives falling within the spirit and scope of the system and method for partial encryption of frame-based electronic content as defined by the appended claims. Any headings used herein are for organizational purposes only and are not meant to limit the scope of the description or the claims. As used herein, the word "may" is used in a permissive sense (i.e., meaning having the potential to), rather than the mandatory sense (i.e., meaning must). Similarly, the words "include", "including", and "includes" mean including, but not limited to.

DETAILED DESCRIPTION OF EMBODIMENTS

Various embodiments of a system and method for creating a thumbnail are described. In the following detailed description, numerous specific details are set forth to provide a thorough understanding of claimed subject matter. However, it will be understood by those skilled in the art that claimed subject matter may be practiced without these specific details. In other instances, methods, apparatuses or systems that would be known by one of ordinary skill have not been described in detail so as not to obscure claimed subject matter.

Some portions of the detailed description which follow are presented in terms of algorithms or symbolic representations of operations on binary digital signals stored within a memory of a specific apparatus or special purpose computing device or platform. In the context of this particular specification, the term specific apparatus or the like includes a general purpose computer once it is programmed to perform particular functions pursuant to instructions from program software. Algorithmic descriptions or symbolic representations are examples of techniques used by those of ordinary skill in the signal processing or related arts to convey the substance of their work to others skilled in the art. An algorithm is here, and is generally, considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals or the like. It should be understood, however, that all of these or similar terms are to be associated with appropriate physical quantities and are merely convenient labels. Unless specifically stated otherwise, as apparent from the following discussion, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Embodiments of the present invention create a thumbnail to represent a view of content. Content may be a window or a plurality of windows arranged on the screen in a layout, a document having a plurality of pages, or other content that is arranged on a display in layers. The thumbnail comprises content that is visually augmented to enhance one or more attributes of the content (e.g., a plurality of scaled windows) being represented by the thumbnail. As such, an attribute of the content, e.g., depth, may be represented by, for example, a specific color such that each scaled window at different depths may have a different color border or highlighting. A user can quickly determine the layered content of a represented screen by viewing the thumbnail.

FIG. 1 depicts a functional block diagram of an apparatus 100 for performing thumbnail generation, according to one or more embodiments. The apparatus comprises a content display generator 104 and a thumbnail generator 106. The thumbnail generator 106 operates within the content display generator 104 for performing thumbnail generation using information regarding each different content to be displayed by the content display generator 104. Content may be a window or a plurality of windows arranged on the screen in a layout, a document having a plurality of pages, or other content that is arranged on a display in layers. Content information is provided from other apparatus, e.g., executing software applications, requiring a display to be generated. The content display generator 104 and the thumbnail generator 106 process the content information 102 to create the display 112 comprising a content display 110 and a thumbnail display 108. According to some embodiments, the content information 102 includes one or more content attributes 114, such as at least one of a content depth, content function, or subject matter of the content and/or the like. The content information 102 further comprises a content definition, e.g., corner location, size, and the like.

In one embodiment, the content display generator 104 is implemented as executable software as described with respect to FIG. 4 below. The content display generator 104 uses the content information 102 to generate a content display 110. The content display 110 may comprise one or more windows having locations, sizes and subject matter defined by the content information 102. The attributes 114 may include content function, subject matter of the content, content depth (e.g., defining which content overlaps other content) and the like.

According to some embodiment, the content display generator 104 includes executable software code that enables the thumbnail generator 106 to create thumbnails. The thumbnail generator 106 receives one or more content attributes 114, from the content information 102, which are used to enhance a thumbnail display 108. The thumbnail generator 106 creates snapshot 118 (e.g., a frame of the display) of at least one portion of a screen (e.g., content display 110). The thumbnail generator 106 scales the snapshot 118 to create a thumbnail. In other embodiments, the snapshot is rendered directly from the content information and scaled to form a thumbnail. Further, the thumbnail generator 106 enhances the created thumbnail by applying visual effects such as transparency, fixed borders, and/or active borders. In one embodiment, the thumbnail generator 106 adds a border to each window having a color matching a background color of the screen (e.g., a 1 pixel wide border). The added border creates a sharp boundary for each window, thus making the thumbnail easy to understand (i.e., the windows in the thumbnail appear to have a 1 pixel separation). As such, the thumbnail generator 106 creates an improved thumbnail 120 in the thumbnail display 108. The thumbnail generator 106 provides additional capability to the thumbnails that is not available in conventional thumbnails. The thumbnail generator 106 generates thumbnails which do not only provide a preview of a particular region, but also reveal subject matter that is hidden behind the subject matter layer(s) at the top. Therefore, a look at the thumbnail 108 is enough to provide the user with the exact preview of all/desired subject matter present at top or behind (in z-order) as well as make apparent the order using various visual effects.

In a specific embodiment, the content information 102 may be provided by collaboration software, such as ADOBE CONNECT available from Adobe Systems Incorporated. A collaboration session represents a group of people communicating for a specific purpose using various web-based tools and services. For each collaboration session, one or more layouts containing a plurality of windows is defined by the content information. A layout contains content information organized into pods. These pods may be organized in a predefined arrangement or may be user arranged. A user may be involved in a collaboration session that results in multiple layouts. Each layout may contain, for example, various windows representing a chat room, a presentation area, a collaborative document and so on. The windows within a layout may partially or completely overlap with other windows. Each layout is selectable to enable a user to select a layout and participate in the collaboration represented by the layout.

Embodiments of the present invention provide an improved thumbnail representing each layout, in order to provide the user with the preview of the layout and a preview of the arrangement of windows in the layout. In the present embodiment, the enhanced thumbnails and window displays eliminate the need for rearranging windows to determine underlying subject matter. For example, a user scenario may comprise several layouts, with each layout representing a different group of collaborators. Only one layout is visible at a time. The user can switch between layouts. Every layout is an arrangement of a number of windows. Any number of windows can be added to a layout. Windows can be resized and moved around in the collaboration area to define a workspace. As a result, windows may overlap each other and only the ones at the top layer of the top layout are visible to the user. As described below, enhanced thumbnails represent each layout such that the content of each layout is discernable to the collaborators.

Figure 2:
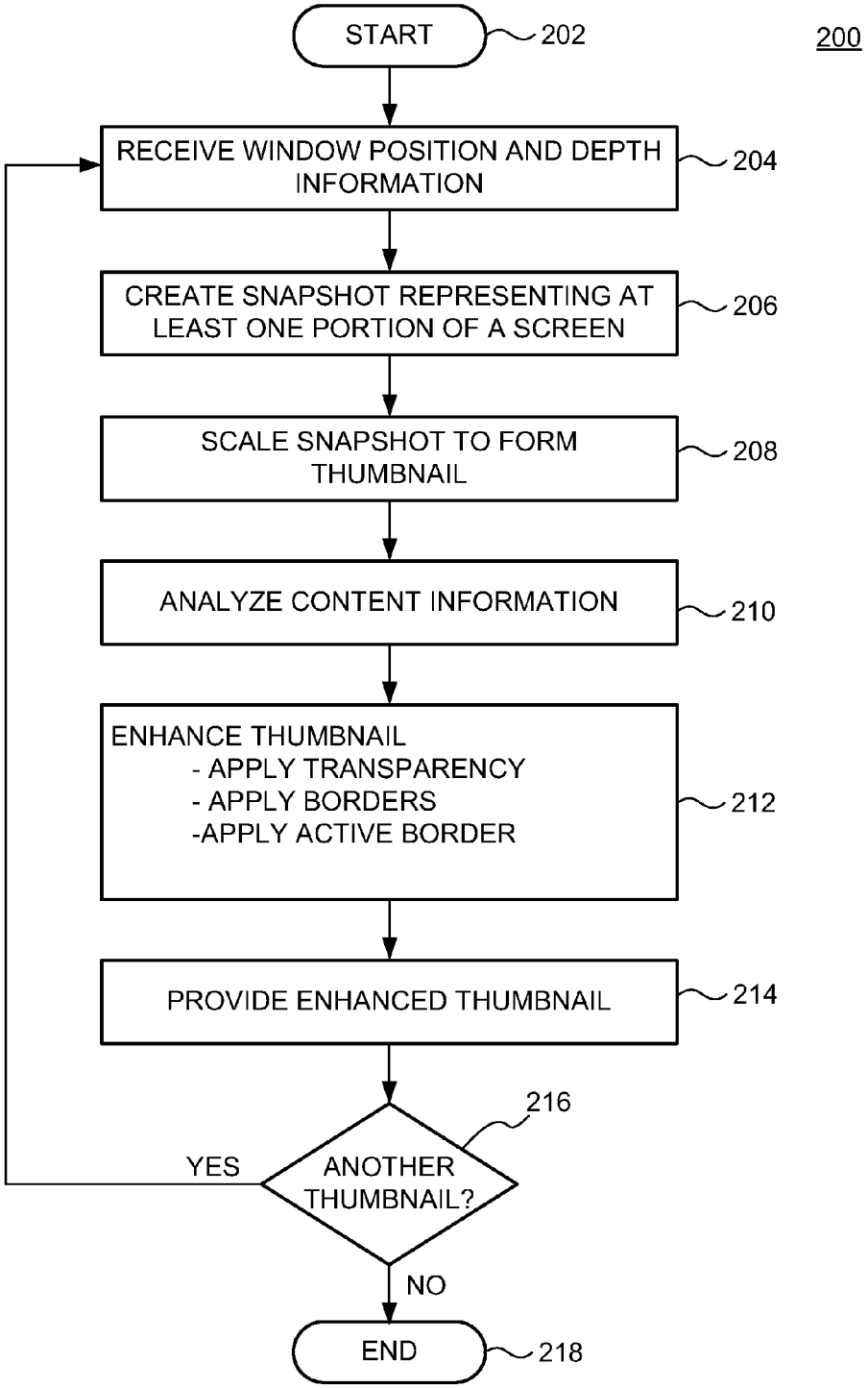
FIG. 2 depicts a flow diagram of a method for performing thumbnail generation using the thumbnail generator of FIG. 1, according to one or more embodiments.

FIG. 2 depicts a flow diagram of a method 200 for performing thumbnail generation using the thumbnail generator of FIG. 1, according to one or more embodiments. The method 200 starts at step 202 and proceeds to step 204. At step 204, the method 200 receives content information. According to some embodiments, the content information (i.e., the content information 102 of FIG. 1) provides data relating to various content attributes, such as the position of a window, depth of a window, size of a window and other related data. These attributes are used by the thumbnail generator (e.g., the thumbnail generator 106 of FIG. 1) to enhance the characteristics of the thumbnail display (e.g., the thumbnail display 108 of FIG. 1).

At step 206, the method 200 creates a snapshot of at least one portion of a screen. The snapshot may include the entire screen or just a part of the screen (e.g., one layout). A region for the snapshot may be user controlled or the method 200 may automatically select the layout on the top layer as the snapshot. In some embodiments, the snapshot may be generated from the content information in the same manner that the content information is used to generate a display (e.g., window display 110). As such, a snapshot may be a rendered image of a view of a screen, a bitmap image (e.g., a screen shot or grab), data defining a view of a screen (whether currently being viewed or not), and the like.

At step 208, the method 200 scales the snapshot to form a thumbnail. The snapshot and its included windows may be scaled using one or more of a variety of well-known image scaling techniques such as sub-sampling, averaging, pixel selections, and the like. In other embodiments, where the snapshot is created directly from the content information, the method 200 may manipulate the content information to generate a scaled snapshot. Specifically, as the content information is used to define a view of a layout, the view is scaled to produce a thumbnail. If the content information is used in this manner, a snapshot of a screen is unnecessary since the thumbnail is generated directly from the content information. Consequently, a view of any layout, whether displayed or not, can be used to generate a thumbnail representing the layout. Herein, a snapshot is broadly defined as a view of an arrangement of content.

At step 210, the method 200 analyzes content information. The method 200 uses the attributes to determine the nature of the enhancement(s) to apply to the thumbnail. In one embodiment, the content information comprises, for example, window corner location and window size for each window in the snapshot as well as window depth. The percentage of scaling of the snapshot to form the thumbnail is applied to the window corner location and window size. Thus, the method 200 determines a location and size of a border of each window within the thumbnail. In other embodiments, the content may be a document and the method 200 uses the attributes to determine the corner and size of the document.

At step 212, the method 200 enhances a characteristic of the content to cause occluded content to be visible to a user. For example, the upper layer content may be semi-transparent such that underlying content is visible through upper layer content. Also, borders of windows may be enhanced with color, or different color for each window. The border colors may be color coordinated to associate a specific color within a particular window depth (z-order), or a specific function (e.g., presentation, chat room, document display, and so on). Further, dashed borders (or other characteristics) may be used to show a window that is hidden by a top layer window. Lastly, an attribute of a window may be that the window contains new information (e.g., a new text message), a window characteristic, such as a border for the newly updated window, may be flashed/blinked or otherwise made attractive to the user. As such, directly within the thumbnail, an indication of a change occurring in a window is clearly evident.

At step 214, the method 200 provides enhanced thumbnail to the window display generator (generator 104 of FIG. 1), which adds the enhanced thumbnail to the display 112.

At step 216, the method 200 queries whether another thumbnail is to be created. If it is determined that another thumbnail is required, the method 200 proceeds to step 202. At step 216, if it is determined that no more thumbnails are to be created, the method 200 proceeds to step 218, where the method 200 ends.

The method 200 may be instantiated each time a layout is altered by the user or by collaborators. The content information includes information indicating when a change has occurred. In this manner, thumbnails for a layout may be updated when the layout is updated (e.g., information added or altered by the user or other collaborators). The thumbnail will track the information available to be displayed on the screen.

Figure 3:
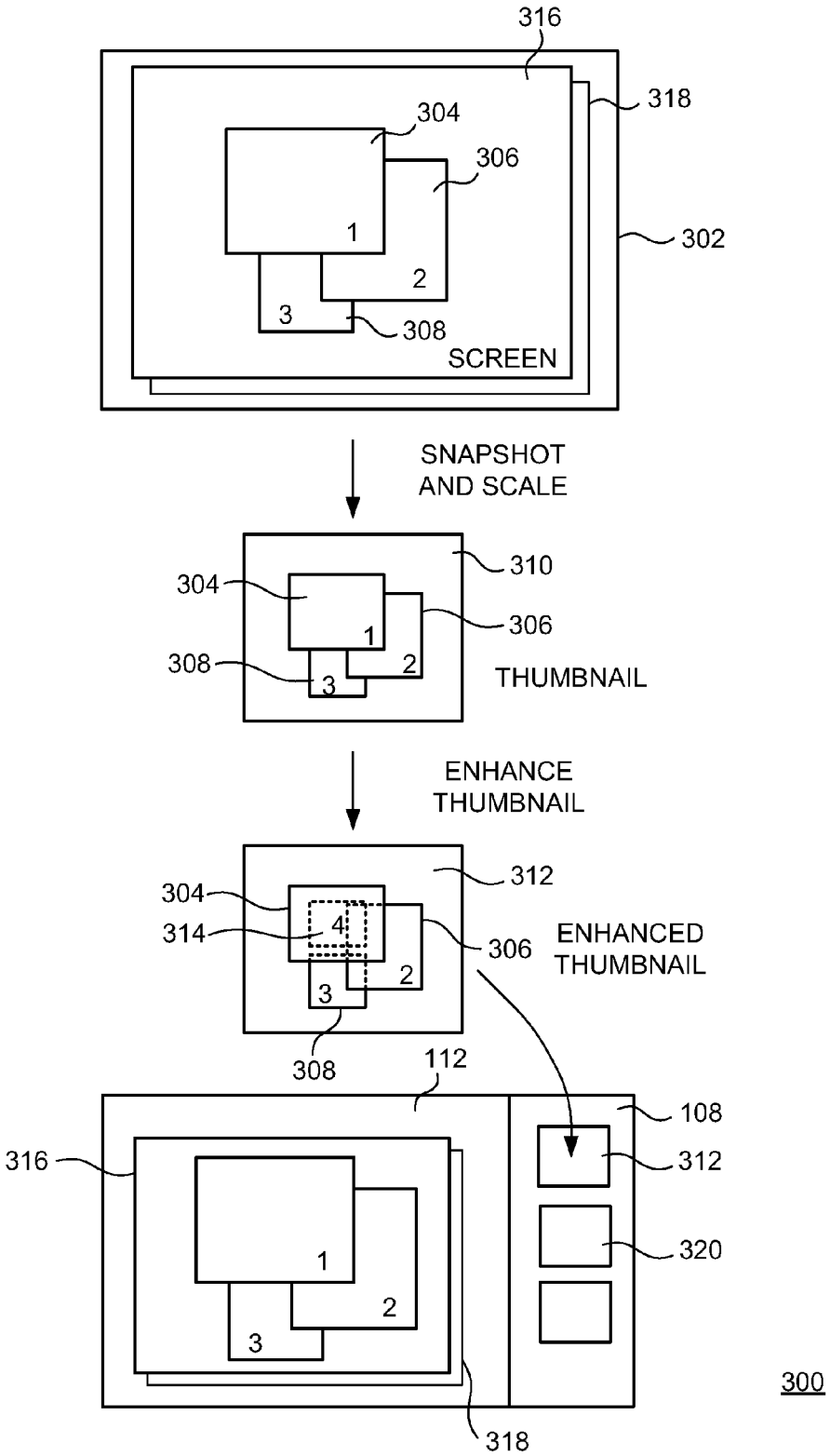
FIG. 3 depicts a schematic illustration of the process for creating a thumbnail using the thumbnail generator of FIG. 1, according to one or more embodiments.

FIG. 3 depicts a schematic illustration of the process 300 for creating a thumbnail in a collaboration environment using the thumbnail generator 106 of FIG. 1, according to one or more embodiments. The process 300 creates snapshot of a layout 316 containing window 1 304, window 2 306, and window 3 305. Other layout(s) may exist, such as layout 318. In one embodiment, each layout 316, 318 contains at least one window, e.g., window 304, 306, 208 in layout 316. The process 300 then scales the snapshot to generate a thumbnail 310 containing the windows 304, 306 and 308. The process enhances the thumbnail 310 to generate an enhanced thumbnail 312. Alternatively, the enhanced thumbnail 312 is generated directly from the snapshot without generating an intermediate thumbnail 310. In some embodiments, the enhancement may be performed by applying transparency, applying borders, and/or applying an active border. In one embodiment, the enhancement process utilizes an alpha value of less than one (<1) to render the background of each window 304, 306 and 308. This enables a partial view of the content behind each window. As a result the content behind is revealed through a semi transparent window. For example, window 314 is now visible through windows 304 and 306. The thumbnail 312 is placed in the thumbnail display 108. A thumbnail 320 representing layout 318 may also be placed in the thumbnail display 108. The user, in a single glance, can see all the content present in the layout and doesn't need to shuffle around the content. The enhanced thumbnail can be presented on the screen for easy visibility.

Figure 4:
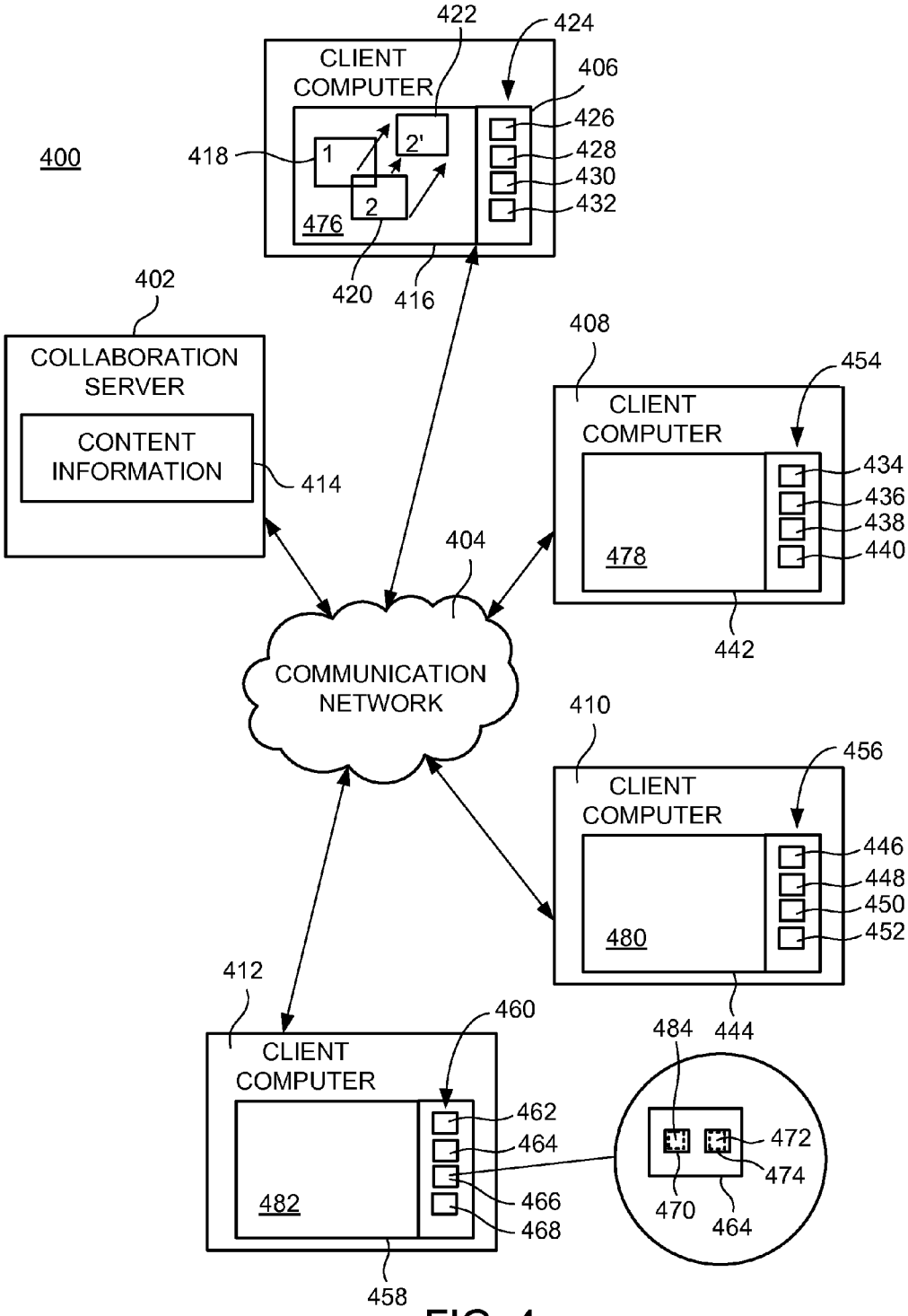
FIG. 4 depicts a block diagram of a collaboration system that, in one embodiment, uses the enhanced thumbnails and the method for generating enhanced thumbnails as described with respect to FIGS. 1-3.

FIG. 4 depicts a block diagram of a collaboration system 400 that, in one embodiment, uses the enhanced thumbnails and the method for generating enhanced thumbnails as described with respect to FIGS. 1-3. The collaboration system 400 comprises a collaboration server 402 and a plurality of client computers (four are shown as 406, 408, 410 and 412) connected to the server 402 via a communications network 404.

Each client computer 406, 408, 410 and 412 executes a content display generator (104 of FIG. 1) as part of, or in conjunction with, collaboration software to generate a respective display 416, 442, 444, 458. In one embodiment, the collaboration software is ADOBE CONNECT®. Each display 416, 442, 444 and 458 respectively presents a window region 476, 478, 480, 482 and a thumbnail region 424, 454, 456, 460. The thumbnail regions 424, 454, 456, 460 comprise thumbnails of the layouts of windows in the window regions 476, 478, 480, 482. Thumbnail region 424 comprises thumbnails 426, 428, 430, and 432; thumbnail region 454 comprises thumbnails 434, 436, 438, 440; thumbnail region 456 comprises thumbnails 446, 448, 450 and 452; and thumbnail region 460 comprises thumbnails 462, 464, 466 and 468.

The collaboration server 402 is provided an event from the client computers 406, 408, 410, 412 whenever a layout is changed. For example, window region 476 of client computer 406 comprises two windows 418 and 420. If a user moves the window 420 to a new location at window 422 as depicted by the arrows, the client computer 406 sends an event to the collaboration server 402. The event is used to update the content information 414. The server 402 distributes the content information to the client computers 406, 408, 410, 412. As such, the client computers 406, 408, 410, 412 update the thumbnail representing the changed layout. For example, client computer 412 may update thumbnail 464 to represent the moved window 422 as scaled window 472 having an enhanced border 474. The enhancement may be a specific color, blinking, and the like to indicate a change has occurred. The unmoved window 418 is shown in the thumbnail 464 as scaled window 470. The border 484 on scaled window 470 is different from border 474 since window 418 is unchanged.

Within ADOBE CONNECT, in one embodiment, a user may interact with a layout offline/private (i.e., an offline mode) such that a layout can be altered without others viewing the layout until the user selects to share the layout. In one embodiment, the layout changes that are performed offline are propagated to the thumbnails of the client computers even when the layout is being created or altered offline. Thus providing an indication to the collaborators that changes are being made to a layout. Alternatively, while in an offline mode, thumbnail changes may occur that represent the online view. The changes to thumbnails, whether offline or online, occurs in real-time. Each change to a layout is instantly reflected in the thumbnails displayed on the collaboration participants' client computers.

Figure 5:
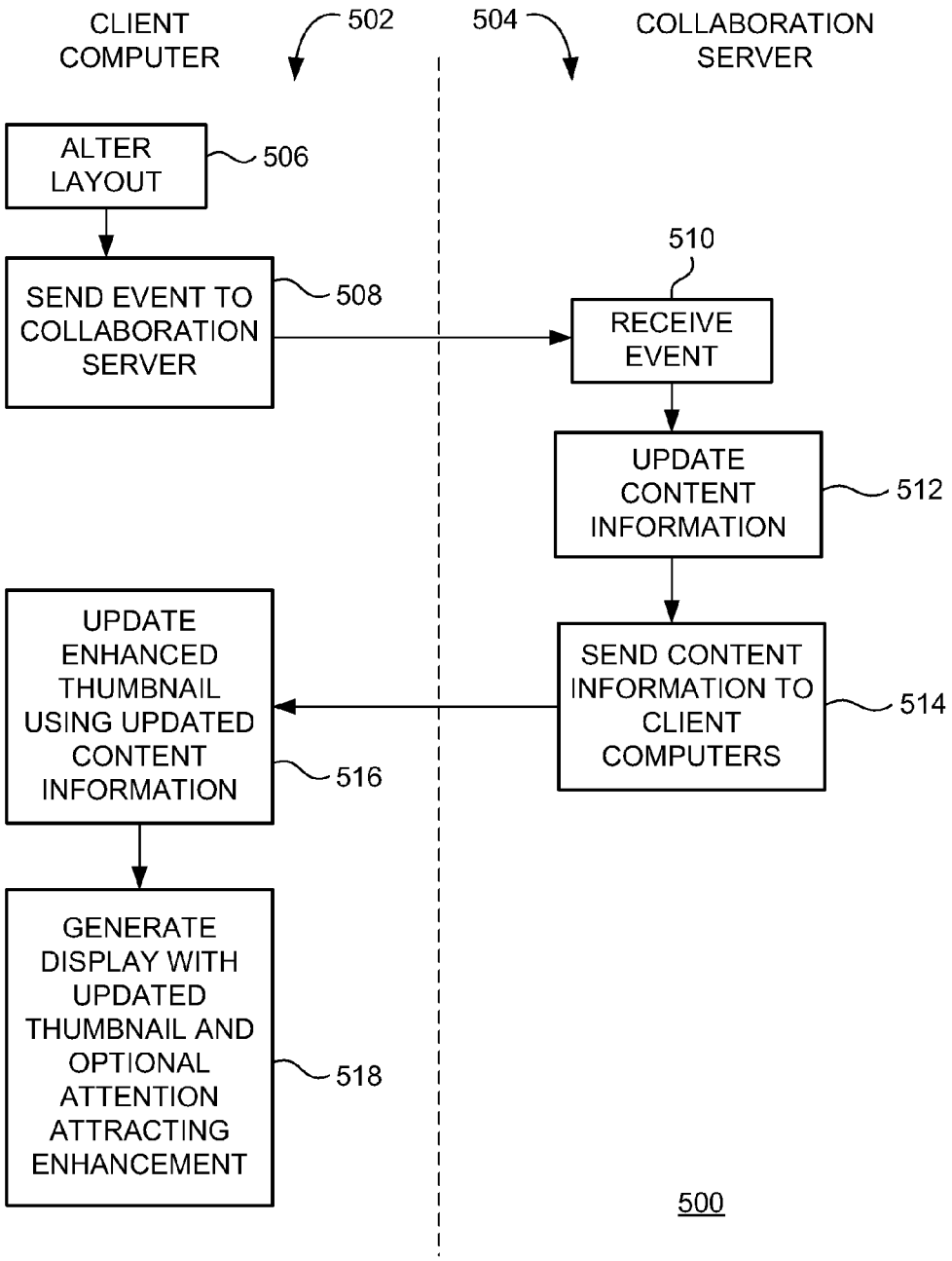
FIG. 5 depicts a flow diagram of one embodiment of a method 500 used to update the thumbnails in a collaborative environment provided by the collaboration system 400 of FIG. 4.

FIG. 5 depicts a flow diagram of one embodiment of a method 500 used to update the thumbnails in a collaborative environment provided by the collaboration system 400 of FIG. 4. The method 500 is divided to show steps performed by the client computer (region 502) and steps performed by the collaboration server (region 504).

At step 506, a layout is altered at the client computer and, at step 508, an event is sent to the collaboration server. At step 510, the server receives the event and, at step 512, updates the content information. At step 514, the updated content information is sent to all the client computers involved in the collaboration session. At step 516, the client computers use the updated content information to update the enhanced thumbnails. At step 518, the method 500 generates a display using the updated enhanced thumbnail and, optionally, applies an attention attracting enhancement to indicate a change has occurred. As such, a change performed by one collaborator is instantly known to the other collaborators even if the layout currently being presented to the collaborator is not the layout that has been changed.

The embodiments of the present invention may be embodied as methods, apparatus, electronic devices, and/or computer program products. Accordingly, the embodiments of the present invention may be embodied in hardware and/or in software (including firmware, resident software, micro-code, etc.), which may be generally referred to herein as a "circuit" or "module". Furthermore, the present invention may take the form of a computer program product on a computer-usable or computer-readable storage medium having computer-usable or computer-readable program code embodied in the medium for use by or in connection with an instruction execution system. In the context of this document, a computer-usable or computer-readable medium may be any medium that can contain, store, communicate, propagate, or transport the program for use by or in connection with the instruction execution system, apparatus, or device. These computer program instructions may also be stored in a computer-usable or computer-readable memory that may direct a computer or other programmable data processing apparatus to function in a particular manner, such that the instructions stored in the computer usable or computer-readable memory produce an article of manufacture including instructions that implement the function specified in the flowchart and/or block diagram block or blocks.

The computer-usable or computer-readable medium may be, for example but not limited to, an electronic, magnetic, optical, electromagnetic, infrared, or semiconductor system, apparatus, device, or propagation medium. More specific examples (a non exhaustive list) of the computer-readable medium include the following: hard disks, optical storage devices, a transmission media such as those supporting the Internet or an intranet, magnetic storage devices, an electrical connection having one or more wires, a portable computer diskette, a random access memory (RAM), a read-only memory (ROM), an erasable programmable read-only memory (EPROM or Flash memory), an optical fiber, and a compact disc read-only memory (CD-ROM).

Computer program code for carrying out operations of the present invention may be written in an object oriented programming language, such as Flex, Java™, Javascript, Smalltalk, C++, Actionscript, and the like. However, the computer program code for carrying out operations of the present invention may also be written in conventional procedural programming languages, such as the "C" programming language and/or any other lower level assembler languages. It will be further appreciated that the functionality of any or all of the program modules may also be implemented using discrete hardware components, one or more Application Specific Integrated Circuits (ASICs), or programmed Digital Signal Processors or microcontrollers.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present disclosure and its practical applications, to thereby enable others skilled in the art to best utilize the invention and various embodiments with various modifications as may be suited to the particular use contemplated.

Example Computer System

Figure 6:
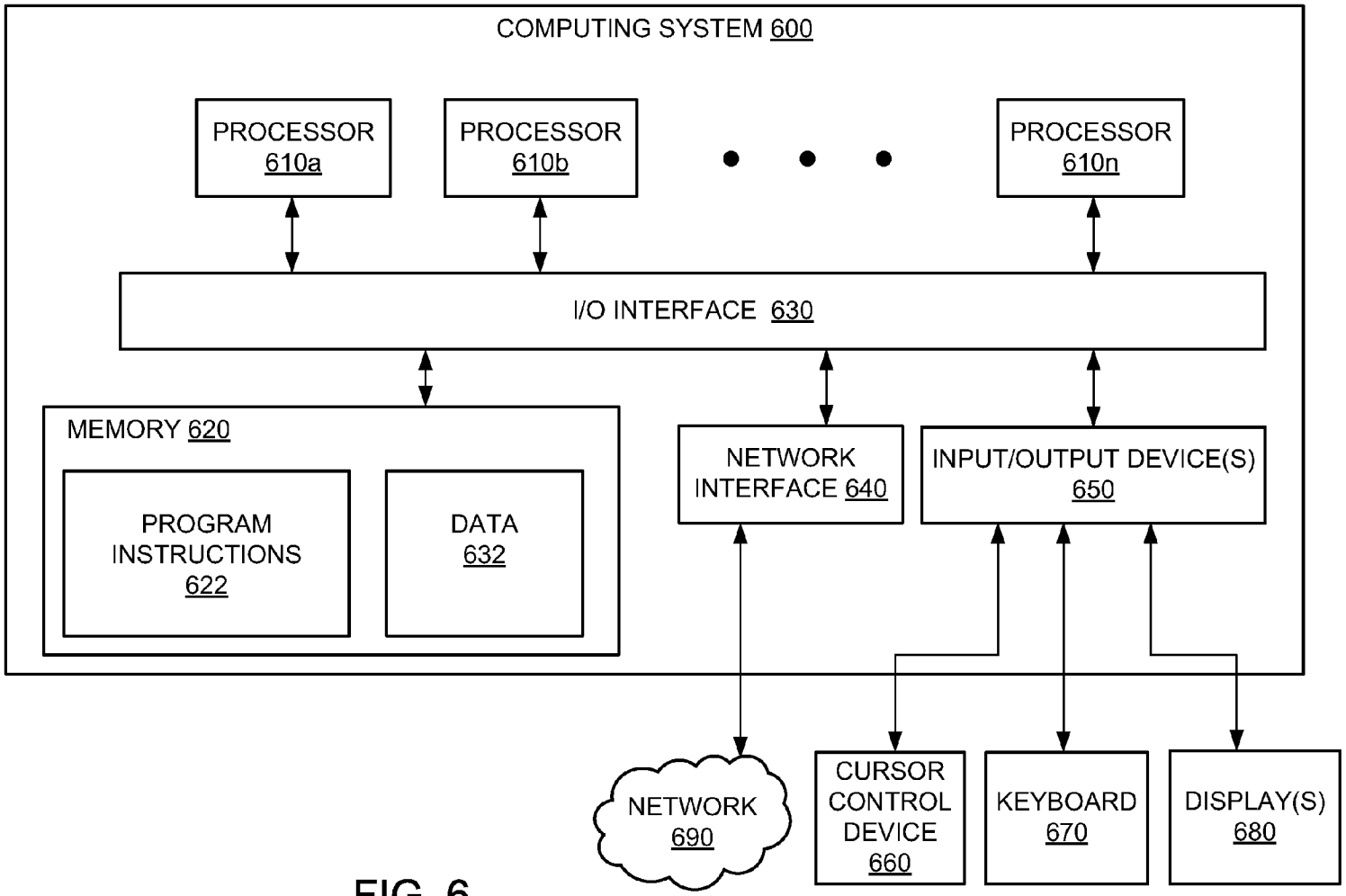
FIG. 6 depicts a computer system that can be utilized in various embodiments of the present invention to implement the thumbnail generator of FIG. 1, according to one or more embodiments.

FIG. 6 depicts a computer system that can be utilized in various embodiments of the present invention, according to one or more embodiments.

Various embodiments of a system and method for creating a thumbnail, as described herein, may be executed on one or more computer systems, which may interact with various other devices. One such computer system is computer system 600 illustrated by FIG. 6, which may in various embodiments implement any of the elements or functionality illustrated in FIGS. 1-3. In various embodiments, computer system 600 may be configured to implement methods described above.

While the illustrated system demonstrates computer system 600 implementing method 200, computer system 600 may be used to implement any other system, device, element, functionality or method of the above-described embodiments. In the illustrated embodiments, computer system 600 may be configured to implement method 200, 300 as processor-executable executable program instructions 622 (e.g., program instructions executable by processor(s) 610) in various embodiments.

In the illustrated embodiment, computer system 600 includes one or more processors 610 coupled to a system memory 620 via an input/output (I/O) interface 630. Computer system 600 further includes a network interface 640 coupled to I/O interface 630, and one or more input/output devices 650, such as cursor control device 660, keyboard 670, and display(s) 680. In various embodiments, any of components may be utilized by the system to receive user input described above. In various embodiments, a user interface (e.g., user interface) may be generated and displayed on display 680. In some cases, it is contemplated that embodiments may be implemented using a single instance of computer system 600, while in other embodiments multiple such systems, or multiple nodes making up computer system 600, may be configured to host different portions or instances of various embodiments. For example, in one embodiment some elements may be implemented via one or more nodes of computer system 600 that are distinct from those nodes implementing other elements. In another example, multiple nodes may implement computer system 600 in a distributed manner.

In different embodiments, computer system 600 may be any of various types of devices, including, but not limited to, a personal computer system, desktop computer, laptop, notebook, or netbook computer, mainframe computer system, handheld computer, workstation, network computer, a camera, a set top box, a mobile device, a consumer device, video game console, handheld video game device, application server, storage device, a peripheral device such as a switch, modem, router, or in general any type of computing or electronic device.

In various embodiments, computer system 600 may be a uniprocessor system including one processor 610, or a multiprocessor system including several processors 610 (e.g., two, four, eight, or another suitable number). Processors 610 may be any suitable processor capable of executing instructions. For example, in various embodiments processors 610 may be general-purpose or embedded processors implementing any of a variety of instruction set architectures (ISAs), such as the x96, PowerPC, SPARC, or MIPS ISAs, or any other suitable ISA. In multiprocessor systems, each of processors 610 may commonly, but not necessarily, implement the same ISA.

System memory 620 may be configured to store program instructions 622 and/or data 632 accessible by processor 610. In various embodiments, system memory 620 may be implemented using any suitable memory technology, such as static random access memory (SRAM), synchronous dynamic RAM (SDRAM), nonvolatile/Flash-type memory, or any other type of memory. In the illustrated embodiment, program instructions and data implementing any of the elements of the embodiments described above may be stored within system memory 620. In other embodiments, program instructions and/or data may be received, sent or stored upon different types of computer-accessible media or on similar media separate from system memory 620 or computer system 600.

In one embodiment, I/O interface 630 may be configured to coordinate I/O traffic between processor 610, system memory 620, and any peripheral devices in the device, including network interface 640 or other peripheral interfaces, such as input/output devices 650, In some embodiments, I/O interface 630 may perform any necessary protocol, timing or other data transformations to convert data signals from one components (e.g., system memory 620) into a format suitable for use by another component (e.g., processor 610). In some embodiments, I/O interface 630 may include support for devices attached through various types of peripheral buses, such as a variant of the Peripheral Component Interconnect (PCI) bus standard or the Universal Serial Bus (USB) standard, for example. In some embodiments, the function of I/O interface 630 may be split into two or more separate components, such as a north bridge and a south bridge, for example. Also, in some embodiments some or all of the functionality of I/O interface 630, such as an interface to system memory 620, may be incorporated directly into processor 610.

Network interface 640 may be configured to allow data to be exchanged between computer system 600 and other devices attached to a network (e.g., network 690), such as one or more external systems or between nodes of computer system 600. In various embodiments, network 690 may include one or more networks including but not limited to Local Area Networks (LANs) (e.g., an Ethernet or corporate network), Wide Area Networks (WANs) (e.g., the Internet), wireless data networks, some other electronic data network, or some combination thereof. In various embodiments, network interface 640 may support communication via wired or wireless general data networks, such as any suitable type of Ethernet network, for example; via telecommunications/telephony networks such as analog voice networks or digital fiber communications networks; via storage area networks such as Fibre Channel SANs, or via any other suitable type of network and/or protocol.

Input/output devices 650 may, in some embodiments, include one or more display terminals, keyboards, keypads, touchpads, scanning devices, voice or optical recognition devices, or any other devices suitable for entering or accessing data by one or more computer systems 600. Multiple input/output devices 650 may be present in computer system 600 or may be distributed on various nodes of computer system 600. In some embodiments, similar input/output devices may be separate from computer system 600 and may interact with one or more nodes of computer system 600 through a wired or wireless connection, such as over network interface 640.

In some embodiments, the illustrated computer system may implement any of the methods described above, such as the methods illustrated by the flowcharts of FIGS. 2. In other embodiments, different elements and data may be included.

Those skilled in the art will appreciate that computer system 600 is merely illustrative and is not intended to limit the scope of embodiments. In particular, the computer system and devices may include any combination of hardware or software that can perform the indicated functions of various embodiments, including computers, network devices, Internet appliances, PDAs, wireless phones, pagers, etc. Computer system 600 may also be connected to other devices that are not illustrated, or instead may operate as a stand-alone system. In addition, the functionality provided by the illustrated components may in some embodiments be combined in fewer components or distributed in additional components. Similarly, in some embodiments, the functionality of some of the illustrated components may not be provided and/or other additional functionality may be available.

Those skilled in the art will also appreciate that, while various items are illustrated as being stored in memory or on storage while being used, these items or portions of them may be transferred between memory and other storage devices for purposes of memory management and data integrity. Alternatively, in other embodiments some or all of the software components may execute in memory on another device and communicate with the illustrated computer system via inter-computer communication. Some or all of the system components or data structures may also be stored (e.g., as instructions or structured data) on a computer-accessible medium or a portable article to be read by an appropriate drive, various examples of which are described above. In some embodiments, instructions stored on a computer-accessible medium separate from computer system 600 may be transmitted to computer system 600 via transmission media or signals such as electrical, electromagnetic, or digital signals, conveyed via a communication medium such as a network and/or a wireless link. Various embodiments may further include receiving, sending or storing instructions and/or data implemented in accordance with the foregoing description upon a computer-accessible medium or via a communication medium. In general, a computer-accessible medium may include a storage medium or memory medium such as magnetic or optical media, e.g., disk or DVD/CD-ROM, volatile or non-volatile media such as RAM (e.g., SDRAM, DDR, RDRAM, SRAM, etc.), ROM, etc.

The methods described herein may be implemented in software, hardware, or a combination thereof, in different embodiments. In addition, the order of methods may be changed, and various elements may be added, reordered, combined, omitted, modified, etc. All examples described herein are presented in a non-limiting manner. Various modifications and changes may be made as would be obvious to a person skilled in the art having benefit of this disclosure. Realizations in accordance with embodiments have been described in the context of particular embodiments. These embodiments are meant to be illustrative and not limiting. Many variations, modifications, additions, and improvements are possible. Accordingly, plural instances may be provided for components described herein as a single instance. Boundaries between various components, operations and data stores are somewhat arbitrary, and particular operations are illustrated in the context of specific illustrative configurations. Other allocations of functionality are envisioned and may fall within the scope of claims that follow. Finally, structures and functionality presented as discrete components in the example configurations may be implemented as a combined structure or component. These and other variations, modifications, additions, and improvements may fall within the scope of embodiments as defined in the claims that follow.

While the foregoing is directed to embodiments of the present invention, other and further embodiments of the invention may be devised without departing from the basic scope thereof, and the scope thereof is determined by the claims that follow.

The invention claimed is:

1. A computer implemented method for creating a thumbnail comprising:

generating a snapshot representing at least a portion of a view containing a plurality of layers of content, wherein at least a portion of a first layer in the plurality of layers overlaps and hides at least a portion of a second layer in the plurality of layers, and where each layer of the content has an attribute;

scaling the snapshot to a reduced size to form the thumbnail;

enhancing a representation of content represented in the thumbnail to generate an enhanced thumbnail based upon the attribute of each layer of the content, wherein enhancing reveals subject matter of the hidden portion of the second layer; and displaying the generated enhanced thumbnail in a display region with one or more enhanced thumbnails, wherein the generated enhanced thumbnail represents content from a computer of a plurality of computers in a collaboration session representing a group of users communicating for a specific purpose, wherein the generated enhanced thumbnail is displayed in computers of the plurality of computers participating in the collaboration session.

2. The method of claim 1, wherein each attribute for each layer of content comprises at least one of content depth, content function, or subject matter of the content.

3. The method of claim 1 wherein each layer of content comprises a window.

4. The method of claim 1, wherein the enhancing step further comprising applying at least one of: a border to a window in a layer, applying highlighting to a window in a layer, or applying transparency to a window in a layer.

5. The method of claim 4 wherein a content depth defines a color for a border of a window, and a color for highlighting a window in each layer.

6. The method of claim 4 wherein the collaboration session results in multiple layouts, each layout is selected to enable participation in the collaboration session represented by the layout.

7. The method of claim 4 wherein an amount of transparency is associated with the layer of the window.

8. An apparatus for creating a thumbnail comprising:

a thumbnail generator generating a snapshot representing at least a portion of a view containing a plurality of layers of content, wherein at least a portion of a first layer in the plurality of layers overlaps and hides at least a portion of a second layer in the plurality of layers, and where each layer of content has an attribute, scaling the snapshot to a reduced size to form a thumbnail, enhancing a representation of content represented in the thumbnail to generate an enhanced thumbnail based upon the attribute of each layer of the content, wherein enhancing reveals subject matter of the hidden portion of the second layer; and displaying the enhanced thumbnail in a display region with one or more generated enhanced thumbnails, wherein the generated enhanced thumbnail represents content from a computer of a plurality of computers in a collaboration session representing a group of users communicating for a specific purpose, wherein the generated enhanced thumbnail is updated on the computer and displayed in computers of the plurality of computers participating in the collaboration session.

9. The apparatus of claim 8, wherein each attribute for each layer of content comprises at least one of content depth, content function, or subject matter of the content.

10. The apparatus of claim 8 wherein each layer of content comprises a window.

11. The apparatus of claim 8, wherein the enhancing step further comprising applying at least one of: a border to a window in a layer, applying highlighting to a window in a layer, applying transparency to a window in a layer.

12. The apparatus of claim 11 wherein a content depth defines a color for a border of a window.

13. The apparatus of claim 11 wherein a content depth defines a color for highlighting a window in each layer.

14. The apparatus of claim 11 wherein an amount of transparency is associated with the layer of the window.

15. A non-transitory computer readable medium for storing processor executable instructions that, when executed by a computing system, causes the computing system to perform a method comprising:

generating a snapshot representing at least a portion of a view containing a plurality of layers of content, wherein at least a portion of a first layer in the plurality of layers overlaps and hides at least a portion of a second layer in the plurality of layers, and where each layer of the content has an attribute;

scaling the snapshot to a reduced size to form the thumbnail;

enhancing a representation of content represented in the thumbnail to generate an enhanced thumbnail based upon the attribute of each layer of the content, wherein enhancing reveals subject matter of the hidden portion of the second layer; and displaying the generated enhanced thumbnail in a display region with one or more generated enhanced thumbnails, wherein the generated enhanced thumbnail represents content from a computer of a plurality of computers in a collaboration session representing a group of users communicating for a specific purpose, wherein the generated enhanced thumbnail is updated on the computer and displayed in computers of the plurality of computers participating in the collaboration session such that content of the snapshot is discernable to the plurality of computers via the enhanced thumbnail.

16. The non-transitory computer readable medium of claim 15, wherein each attribute for each layer of content comprises at least one of content depth, content function, or subject matter of the content.

17. The non-transitory computer readable medium of claim 15, wherein the enhancing step further comprising applying at least one of: a border to a window in a layer, applying highlighting to a window in a layer, applying transparency to a window in a layer.

18. A computer implemented method for creating and updating a thumbnail within a collaborative environment comprising:

a) generating a thumbnail representing at least a portion of a view of content displayable on a first client computer in a plurality of client computers in a collaboration session;

b) displaying the thumbnail in a thumbnail region on each client computer in the plurality of client computers;

c) repeating steps a) and b) for each client computer in the plurality of client computers in the collaboration session d) upon the content being altered using the first client computer, updating the thumbnail displayed in the thumbnail region on each client computer in the plurality of client computers in the collaboration session communicating for a specific purpose; and e) enhancing a representation of the altered content represented in the thumbnail via an intermediate thumbnail, and wherein enhancing identifies what content in the thumbnail is altered.

19. The method of claim 18 further comprising:

sending an event to a collaboration server upon the content being altered;

updating, in response to the event, content information at the collaboration server;

sending the updated content information from the collaboration server to each client computer in the plurality of client computers;

updating the thumbnail using the updated content information.

20. The method of claim 18 further comprising updating the thumbnail when the first client computer is privately altering the content.

* * * * *